US007275376B2

(12) United States Patent
Swofford et al.

(10) Patent No.: US 7,275,376 B2
(45) Date of Patent: Oct. 2, 2007

(54) DEFROST SYSTEM FOR A REFRIGERATION DEVICE

(75) Inventors: Timothy Dean Swofford, Midlothian, VA (US); Larry C. Howington, Chesterfield, VA (US); Arnold M. Stephens, Powhatan, VA (US); Robert D. Tanner, Chesterfield, VA (US)

(73) Assignee: Dover Systems, Inc., Duluth, GA (US)

( * ) Notice: Subject to any disclaimer, the term of this patent is extended or adjusted under 35 U.S.C. 154(b) by 142 days.

(21) Appl. No.: 11/116,559

(22) Filed: Apr. 28, 2005

(65) Prior Publication Data

US 2006/0242982 A1 Nov. 2, 2006

(51) Int. Cl.
*F25B 41/04* (2006.01)

(52) U.S. Cl. ..... 62/81; 62/155; 62/225; 62/234

(58) Field of Classification Search ..... 62/80–81, 62/151–156, 222–225, 234, 277; 165/267–269
See application file for complete search history.

(56) References Cited

U.S. PATENT DOCUMENTS 2,047,249 A * 7/1936 Ballard ..... 62/225
3,427,819 A 2/1969 Seghetti
3,677,025 A 7/1972 Payne
3,937,033 A 2/1976 Beckwith et al.
4,167,102 A 9/1979 Willitts
4,265,092 A 5/1981 Abraham
4,370,867 A 2/1983 Ibrahim
4,375,155 A 3/1983 Rosanio et al.
4,404,816 A 9/1983 Ibrahim et al.
4,457,139 A 7/1984 Ibrahim
4,514,988 A 5/1985 Ibrahim
4,565,070 A 1/1986 Raymond
4,577,467 A 3/1986 Ibrahim et al.
4,979,371 A 12/1990 Larson
4,993,233 A 2/1991 Borton et al.
5,048,303 A 9/1991 Campbell et al.
5,323,621 A 6/1994 Subera et al.
5,551,248 A * 9/1996 Derosier ..... 62/155
5,813,242 A 9/1998 Lawrence et al.

(Continued)

FOREIGN PATENT DOCUMENTS

JP 5-296646 A 11/1993

(Continued)

OTHER PUBLICATIONS

PCT International Search Report, based on International Application No. PCT/US2006/014177, date of mailing of the International Search Report Sep. 15, 2006 (2 pp.).

*Primary Examiner*—William E. Tapolcai
(74) *Attorney, Agent, or Firm*—Foley & Lardner LLP

(57) ABSTRACT

A defrost system for a temperature controlled storage unit includes an enclosure providing a space for storage of products. A refrigeration system has a supply line and a return line coupled to a cooling element to circulate a refrigerant through the cooling element to provide cooling to the space. A control module initiates a plurality of defrost modes on a predetermined frequency and for a predetermined duration by reducing a flow rate of the refrigerant through the cooling element so that a superheat temperature of the refrigerant in the cooling coil is increased to a predetermined range.

30 Claims, 3 Drawing Sheets

U.S. PATENT DOCUMENTS

| | | | | |
|---|---|---|---|---|
| 6,076,368 | A * | 6/2000 | Noble | 62/217 |
| 6,089,033 | A | 7/2000 | Dubé | |
| 6,094,925 | A | 8/2000 | Arshansky et al. | |
| 6,141,981 | A * | 11/2000 | Reason et al. | 62/225 |
| 6,170,270 | B1 | 1/2001 | Arshansky et al. | |
| 6,185,958 | B1 | 2/2001 | Wightman | |
| 6,286,322 | B1 | 9/2001 | Vogel et al. | |
| 6,397,629 | B2 | 6/2002 | Wightman | |
| 6,449,967 | B1 | 9/2002 | Dubé | |
| 6,467,282 | B1 | 10/2002 | French et al. | |
| 6,684,650 | B2 | 2/2004 | Weyna et al. | |
| 6,711,911 | B1 | 3/2004 | Grabon et al. | |
| 6,745,583 | B2 * | 6/2004 | So et al. | 62/156 |
| 6,775,993 | B2 | 8/2004 | Dubé | |
| 6,945,059 | B1 * | 9/2005 | Reason et al. | 62/155 |
| 2005/0126198 | A1 | 6/2005 | Marchand et al. | |
| 2005/0138936 | A1 | 6/2005 | Dubé | |

FOREIGN PATENT DOCUMENTS

| | | | |
|---|---|---|---|
| JP | 6-88662 | A | 3/1994 |
| KR | 1996-0018479 | A | 6/1996 |
| KR | 1998-0010300 | A | 4/1998 |
| KR | 1998-0015187 | A | 5/1998 |

* cited by examiner

DEFROST SYSTEM FOR A REFRIGERATION DEVICE

FIELD

The present inventions relate to a defrost system for use in a refrigeration device. The present inventions relate more particularly to defrost system that provides frequent, short-duration defrosts of a cooling element associated with the refrigeration device. The present invention relates more particularly to a defrost system that defrosts the cooling element by modulating the superheat temperature of refrigerant within the cooling element.

BACKGROUND

It is generally known to provide refrigeration devices (e.g. temperature controlled cases, refrigerated storage units, merchandisers, coolers, etc.) having a refrigeration system for circulating a refrigerant or coolant through one or more cooling elements within the case to maintain items (such as food products and the like) within a certain desirable temperature range. The temperature of the refrigerant circulated through the cooling element(s) is usually below 32 degrees F. When moisture in the air within the case contacts the surface of the cooling element (e.g. by forced or natural circulation) the moisture tends to freeze. Over time, a build-up of frost and/or ice accumulates on the surface of the cooling elements and tends to reduce the performance and the efficiency of the temperature controlled case. It is also generally known to provide defrost systems for removing frost and/or ice from the surfaces of the cooling element that accumulate during operation of the case in a cooling mode.

Such defrost systems typically involve at least one of three conventional methods. A first type of defrost system interrupts the cooling mode to stop circulation (or cooling) of a refrigerant for a sufficient period of time (e.g. "time-off" defrost) so that the temperature of the cooling element rises above the freezing point (i.e. 32 degrees F) and the accumulated frost and ice melt into a drain pan or the like for removal from case. However, such time-off defrost systems tend to permit the temperature of food products stored within the case to fluctuate to an extent that may lead to more rapid degradation of the food product. A second type of defrost system interrupts the cooling mode and energizes electric heating elements coupled to (or adjacent to) the cooling element for a sufficient period of time to melt the accumulated frost and ice for drainage from the case. However, such heating elements may increase thermal shock and stress to the cooling element material during defrosting and tends to add heat to the case. A third type of defrost system interrupts the cooling mode to circulate a heated fluid (such as hot refrigerant gas or warmed secondary coolant) through the cooling coil to melt accumulated frost and ice for drainage from the case. However, such hot gas or warmed coolant systems typically require additional components and controls that tend to increase the complexity of the case and also add heat to the case. Therefore, the typical defrost systems may tend to reduce the overall thermal performance of the case and may cause undesirable degrees of thermal shock and/or stress to components of the cooling system, and add heat to the case.

Accordingly, it would be desirable to provide a defrost system for a cooling element in a temperature controlled case that minimizes the duration of the defrost mode, so that temperature fluctuation of products within the case is minimized and thermal stress of the cooling element and addition of heat to the case is minimized. It would also be desirable to provide a defrost system that operates on an increased frequency to perform frequent, short-duration "mini-defrosts." It would also be desirable to provide a defrost system that modulates the flow of refrigerant through the cooling element to increase the average temperature of the cooling element slightly above the freezing point (i.e. 32 degrees F) during the mini-defrosts. It would be further desirable to provide a defrost system that regulates a throttle device (such as a superheat valve) to modulate the flow of refrigerant during the mini-defrosts. It would also be desirable to control the frequency of the mini-defrosts in a time-based manner. It would be further desirable to control the frequency of the mini-defrosts in a demand-based manner.

Accordingly, it would be desirable to provide a defrost system for a temperature controlled case having any one or more of these or other desirable features.

SUMMARY

According to one embodiment, a temperature controlled case includes an enclosure defining an airspace for storage of products therein. A refrigeration system circulates a refrigerant through an expansion device and at least one cooling element to cool the airspace.

A control module modulates a position of the expansion device during a cooling mode so that a flow rate of the refrigerant corresponds to a first cooling element temperature less than or equal to approximately 32 degrees F. and modulates a position of the expansion device during a defrost mode to reduce the flow rate of the refrigerant to correspond to a second cooling element temperature greater than approximately 32 degrees F.

According to another embodiment, a refrigeration device includes a case having a space configured for storage of products to be cooled. At least one cooling element is coupled to the case to provide cooling to the space. A refrigeration system has a supply line and a return line to circulate a refrigerant through the cooling element and an expansion device is coupled to the supply line. A control module operates to defrost the cooling element at periodic intervals by modulating the expansion device to reduce a flow rate of the refrigerant and increase a superheat temperature of the refrigerant within the cooling element so that an average temperature of the cooling element exceeds 32 degrees F. for a predetermined duration.

According to another embodiment, a defrost system for a temperature controlled storage unit includes an enclosure providing a space for storage of products. A refrigeration system has a supply line and a return line coupled to a cooling element to circulate a refrigerant through the cooling element to provide cooling to the space. A control module initiates a plurality of defrost modes on a predetermined frequency and for a predetermined duration by reducing a flow rate of the refrigerant through the cooling element so that a superheat temperature of the refrigerant in the cooling coil is increased to a predetermined range.

According to another embodiment, a method for defrosting a temperature controlled case includes providing an enclosure having a space configured to receive products to be cooled and providing a cooling element configured to receive a refrigerant to cool the space. A control module operable to receive signals representative of at least one of a refrigerant pressure and a refrigerant temperature is provided to module a superheat valve to conduct mini-defrosts on the cooling element by reducing the flow rate of the refrigerant through the cooling element so that a superheat temperature of the refrigerant is sufficient to warm the cooling element above freezing.

DETAILED DESCRIPTION

Figure 1:
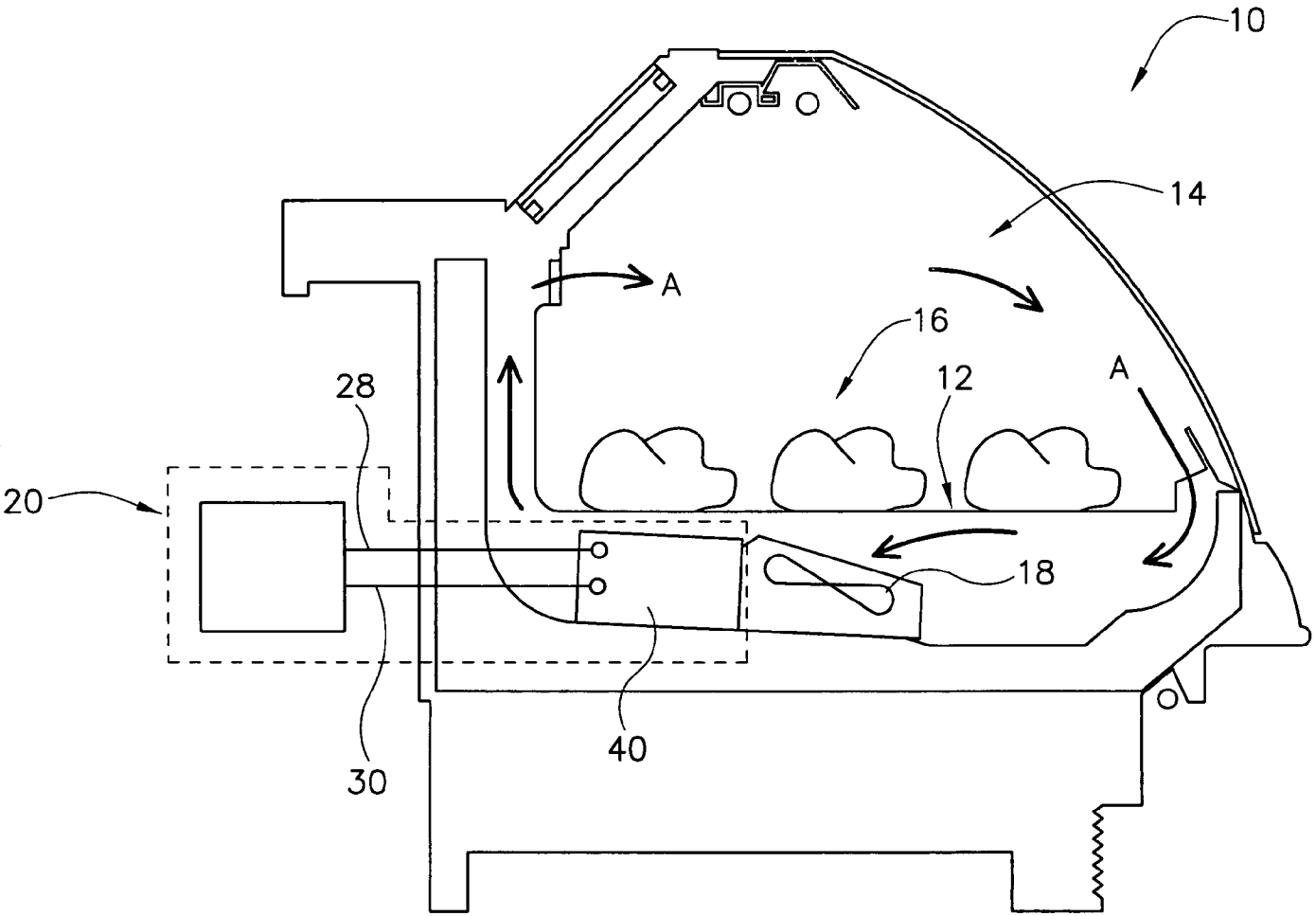
FIG. 1 is a schematic image of a side elevation view of a temperature controlled case according to an exemplary embodiment.

Referring to the FIGURES, a defrost system for use with one or more cooling elements (e.g. coils, finned-coils, heat exchangers, flow-through pans, etc.) in a refrigeration device such as a temperature controlled case is shown according to one embodiment. The temperature controlled case is shown to have a refrigeration system having a compressor, condenser, expansion device and suitable sensors for circulating a fluid (such as a refrigerant or coolant) through the cooling element to maintain the temperature of products, such as food products within a storage area of the case, at a relatively constant storage temperature. The defrost system is shown to include a control module that interfaces with appropriate components of the case and the refrigeration system. The control module is intended to conduct relatively frequent, short duration "mini-defrosts" on the cooling element using the expansion device (e.g. a throttling device such as a superheat valve) to increase the superheat temperature of the refrigerant within the cooling element. A mini-defrost is performed by regulating or modulating the position of the superheat valve to reduce the flow of refrigerant therethrough, so that the refrigerant within the cooling element absorbs an increased amount of heat from a product storage area within the case. As the refrigerant absorbs an increased amount of heat, the refrigerant changes from a generally liquid-vapor mixture to a vapor. Increasing the temperature of the vapor above the refrigerant's saturation temperature (due in part to the reduced flow rate of the refrigerant through the cooling element) is intended to increase the average temperature of the refrigerant within the coil above 32 degrees F. for a relatively short period of time. The mini-defrosts are performed on a frequency that is intended to limit an accumulation of frost and/or ice on the cooling element to a relatively small or "light" accumulation, so that the generally short duration of the mini-defrost and the limited temperature increase from the mini-defrost is sufficient to minimize (or eliminate) the layer of frost and/or ice on the cooling element. By conducting frequent "mini-defrosts" the defrost system is intended to minimize the amount of frost and/or ice that accumulates on the cooling element so that performance of the cooling element is enhanced. The performance of the case and the cooling element are enhanced by (among others) minimizing variations in the frost and/or ice layer thickness on the cooling element, and minimizing fluctuation in the temperature of the products within the case so that energy used to "draw down" the temperature of the products in the case to their storage temperature is minimized after the mini-defrost.

According to one embodiment, the mini-defrosts conducted by the defrost system are accomplished using the superheat valve of the refrigeration system to control the temperature of the cooling element. When the defrost system indicates that a mini-defrost is to be conducted, a signal is sent to the superheat valve to reduce the flow of refrigerant through the cooling element a sufficient amount so that the temperature of the refrigerant in the cooling element increases above the freezing point (i.e. 32 degrees F) by a sufficient temperature to melt the relatively "light" amount of frost and/or ice accumulated since the last mini-defrost. The frequency of the mini-defrosts may be based on a suitable control strategy. For example, the defrost control module may be configured to implement a "time based" strategy that is established according to known or predicted demand conditions. By further way of example, the defrost control module may be configured to implement a "demand based" strategy (e.g. anticipatory, etc.) that monitors certain parameters representative of demand on the refrigeration device (e.g. temperature of the coil surface, refrigerant pressure, temperature of the air space, temperature difference between the airspace and the heat exchange surface, rate of change of the temperatures, frost thickness, static pressure difference across the coil, fan motor current, etc.) and initiates a mini-defrost according to the indicated demand.

The defrost system may be configured to control the frost and/or ice accumulation on the cooling element(s) of the case using a defrost strategy involving only mini-defrosts. However, the defrost system may also be configured to conduct mini-defrosts during periods of increased demand on the case (e.g. daytime store hours when consumers or employees periodically access or open the case for loading or removal of products from the product storage area of the case) and to conduct "conventional" defrosts during periods of decreased demand (e.g. nighttime hours when the store is closed, or when consumer traffic is reduced). By further way of example, the defrost system may also be configured to conduct mini-defrosts on a first frequency and conventional defrosts on a second, lesser frequency if demand on the case exceeds the frost removal capability of the mini-defrost strategy (e.g. in response to seasonal or regional temperature and/or humidity variations, in response to variations in access to, or loading of, the case, etc.). Accordingly, all such modifications are intended to be within the scope of the invention as disclosed in reference to the embodiments illustrated and described herein.

Referring to FIG. 1, a defrost system for a refrigeration device shown schematically as a temperature controlled case 10 is shown according to an exemplary embodiment. The case 10 is shown as a rear-access, service-type case, but may be any suitable enclosure for maintaining a temperature controlled environment for the storage of objects such as food products and the like (such as open front or open top cases, closed door cases, etc.). The case is shown to include a product support surface 12 within an airspace 14 for storage of products 16, and cooling element(s) 40 configured to cool air circulated with the airspace 14 by a fan 18. According to alternative embodiments, the cooling element (s) may be positioned at any suitable location within the airspace and the air may be circulated by any type of forced or natural circulation. Moisture in the air within the airspace (e.g. from the products or from moisture in the ambient air that enters during access to the case, etc.) tends to condense and freeze on the surfaces of the cooling element(s) 40 and accumulates over time. The case also includes a defrost system intended to minimize or generally eliminate the layer of accumulated frost and/or ice on the surfaces of the cooling element(s) 40.

Referring to FIGS. 1-3B, a refrigerant system 20 circulates a refrigerant through a closed loop system shown to include a compressor 22 for compressing a refrigerant vapor, a condenser 24 for cooling and condensing the compressed refrigerant vapor, an expansion metering device (e.g. throttle valve, electronic expansion valve, etc.—shown as a superheat valve 26) for "expanding" the liquid refrigerant to a low-temperature saturated liquid-vapor mixture for use in cooling element(s) 40 for cooling airspace 14 and products 16 within the case 10. According to a preferred embodiment, the refrigerant is any commercially available refrigerant, but may be any suitable refrigerant for use with a refrigeration device. The refrigeration system 20 may be self-contained within the case (as shown schematically in FIGS. 2C and 2D) or a portion of the refrigeration system may be located remotely from the case (as shown schematically in FIGS. 1 and 2A-2B).

According to one embodiment, the refrigerant flows through a refrigerant supply line 28 (e.g. "liquid line" etc.) to the superheat valve 26 at a first flow rate and is expanded by the superheat valve 26 to form a liquid-vapor mixture at a "saturation temperature" within the cooling element(s) 40 that is typically below 32 degrees F. during a cooling mode of operation to maintain the temperature of the food products 16 at a desired storage or display temperature, consistent with store or industry food safety codes or guidelines.

According to one exemplary embodiment, the saturation temperature of the refrigerant is typically within a range of approximately 17-32 degrees F, and more particularly within a range of 22-29 degrees F. and is intended to maintain at least a portion of the cooling element(s) 40 at a temperature corresponding approximately to the refrigerant's saturation temperature during the cooling mode. As the saturated liquid-vapor mixture of refrigerant progresses through the cooling element(s) 40 and absorbs heat from the air circulated from the airspace 14, the vapor percentage of the liquid-vapor mixture increases, and usually becomes completely vaporized. When the refrigerant is completely vaporized within a portion of the cooling element(s) 40 (e.g. usually at or near an outlet portion of the cooling element, such as the last one or several tube passes of a coil), the refrigerant temperature increases above the refrigerant's saturation temperature as the refrigerant continues to circulate through the cooling element(s) 40. The amount of temperature increase above the saturation temperature is referred to herein as the "superheat temperature."

During the cooling mode of operation, the superheat valve 26 is configured to modulate a flow rate of the refrigerant corresponding to the duty or demand experienced by the case 10. The flow rate may be increased during high demand and the flow rate may be decreased during low demand, so that the temperature of refrigerant in the cooling element(s) 40 does not exceed approximately 32 degrees F. For example, according to one embodiment where the saturation temperature of refrigerant entering the cooling element(s) 40 from the superheat valve 26 is controlled at approximately 22 degrees F, the flow rate of refrigerant may be modulated to permit a superheat temperature at the exit of the cooling element(s) 40 to be maintained within a range of approximately 3-8 degrees F, such that the temperature of the cooling element(s) 40 does not exceed approximately 32 degrees F. Similarly, for embodiments having other saturation temperatures, the superheat valve is modulated accordingly so that the temperature of the cooling element(s) does not exceed approximately 32 degrees. However, operation of the case 10 with temperatures of the refrigerant and cooling element(s) 40 below 32 degrees F. tends to result in accumulation of ice and/or frost on the surfaces of the cooling element(s) 40, from the condensation and freezing of moisture from the airspace 14.

Referring further to FIGS. 2A-2D, a control module 50 is provided to modulate the position of the superheat valve during the cooling mode and the defrost mode, according to an exemplary embodiment. Control module 50 includes a suitable computing device (such as a microprocessor or programmable logic controller 52) configured to receive signals representative of temperature and/or pressure from the components of the case and to provide output signals for controlling the position of the superheat valve 26 to maintain the superheat temperature of the refrigerant within a desired range for both the cooling mode and the defrost mode.

Figure 2B:
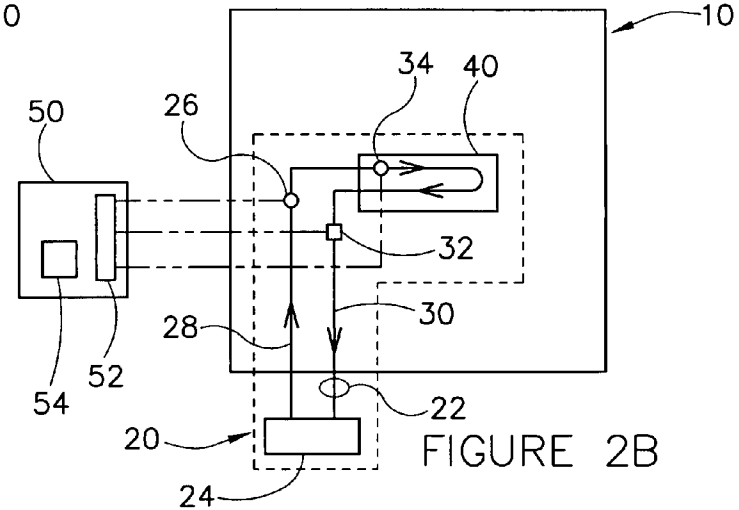
FIGS. 2A-2D are schematic images of a block diagram of a defrost system for a temperature controlled case according to exemplary embodiments.
Figure 2A:
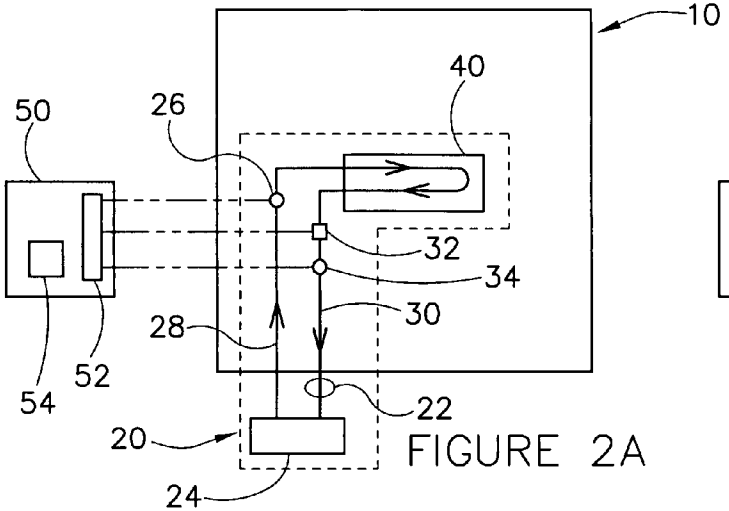
Figure 2D:
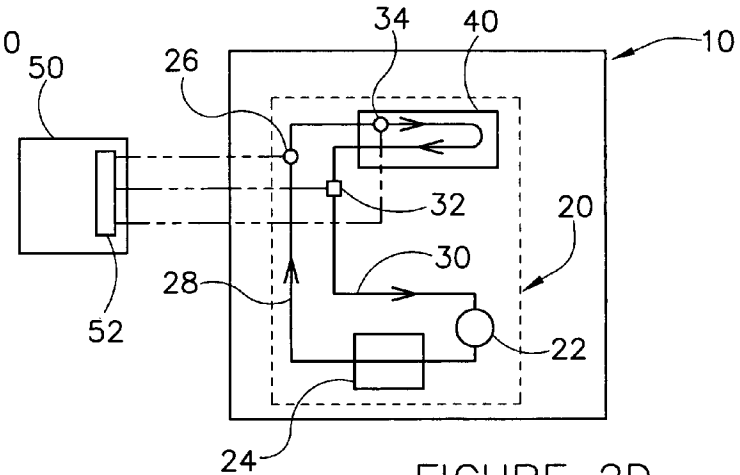
Figure 2C:
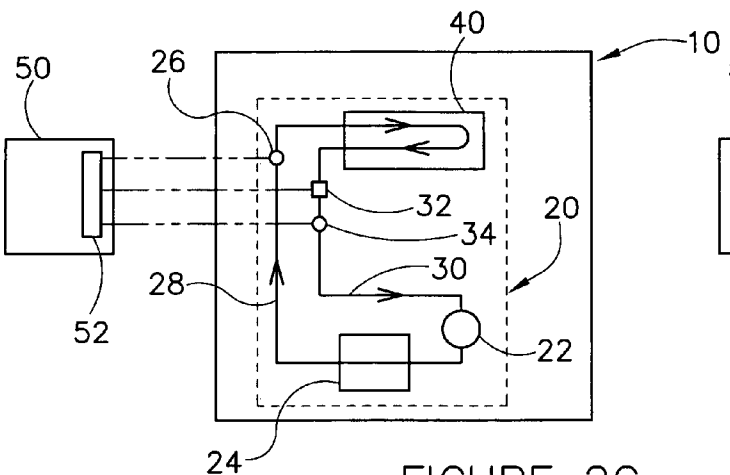
Figure 3A:
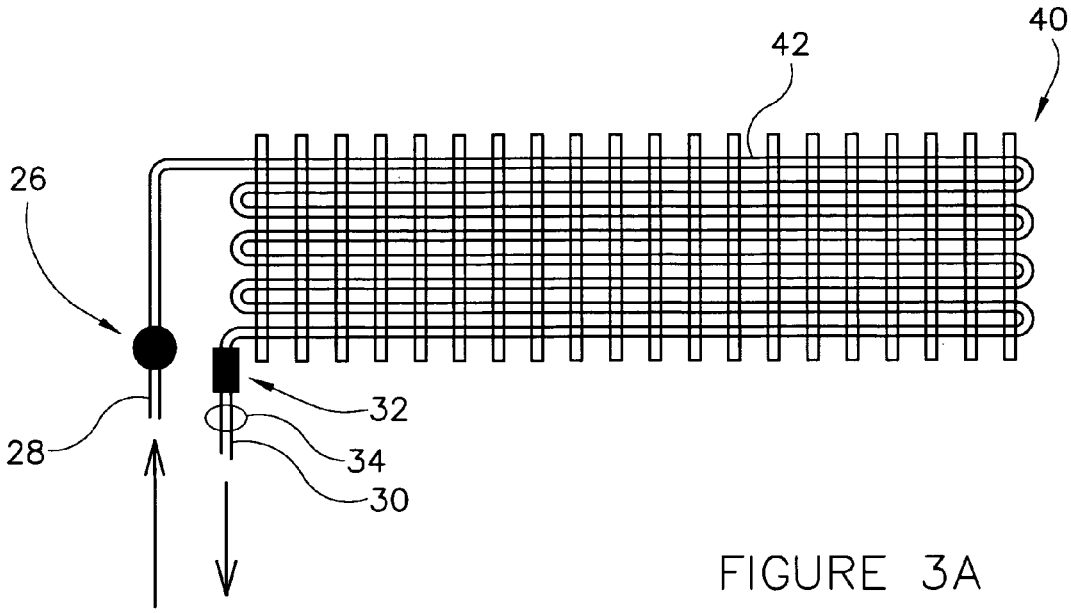
FIG. 3A-3B are schematic images of a portion of a defrost system for a temperature controlled case according to exemplary embodiments.

Referring to FIGS. 2A, 2C and 3A, a temperature/pressure sensing arrangement is shown to include a temperature sensor 32 and a pressure sensor 34 provided on a refrigerant return line 30 (e.g. "suction" line, etc.) adjacent to the exit of the cooling element(s) 40. The pressure sensor 34 provides a signal representative of refrigerant pressure to the control module 50, which calculates a corresponding saturation temperature (T sat) of the refrigerant at the exit of the cooling element(s) 40. The temperature sensor 32 provides a signal representative of actual temperature of the refrigerant at the exit of the cooling element(s) 40 (T exit). The control module 50 calculates the difference between T exit and T sat to determine the actual superheat temperature of the refrigerant. The control module 50 compares the actual superheat temperature of the refrigerant to a predetermined desired range or setpoint for the superheat temperature and sends an output signal to modulate the position of the superheat valve 26 to attain or maintain the desired superheat temperature at the exit of the cooling element(s) 40. According to a currently preferred embodiment, the temperature sensor 32 is a commercially available thermistor (but could be a thermocouple or RTD of the like) and the pressure sensor 34 is a commercially available pressure transducer.

Figure 3B:
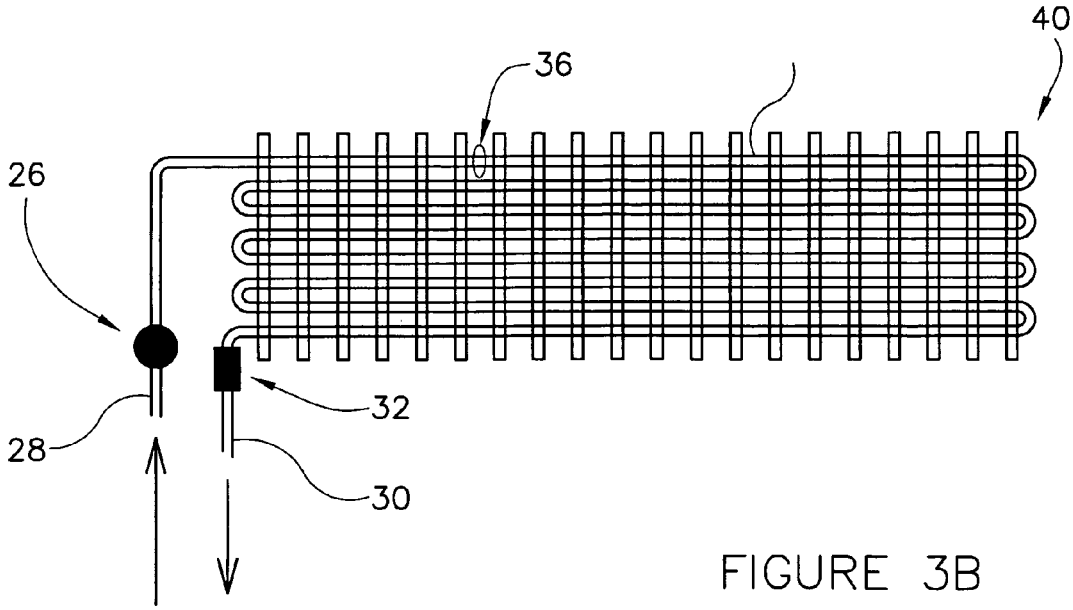

Referring to FIGS. 2B, 2D and 3B, a temperature/temperature sensing arrangement is shown to include a first temperature sensor 36 located at an inlet area of the cooling element(s) (e.g. on a first pass of a coil 42 of a cooling element, etc.) and a second temperature sensor 32 located adjacent to the exit of the cooling element(s) 40. The first temperature sensor 36 is intended to provide a signal that is reasonably representative of the saturation temperature (T sat) of the refrigerant to the control module 50. The second temperature sensor 32 is intended to provide a signal representative of the actual temperature of the refrigerant at the exit of the cooling element(s) 40 (T exit). The control module 50 calculates the difference between T exit and T sat to determine the actual superheat temperature of the refrigerant. The control module 50 compares the actual superheat temperature of the refrigerant to a predetermined desired range or setpoint for the superheat temperature and sends an output signal to modulate the position of the superheat valve to attain or maintain the desired superheat temperature at the exit of the cooling element. According to alternative embodiments, the temperature and/or pressure sensors may be provided at any suitable location and on any suitable component to provide signals sufficient to control the superheat temperature of the refrigerant as the refrigerant passes through the cooling element.

According to one embodiment with a case having a refrigeration system 20 configured for a saturation temperature of approximately 22 degrees F, the control module 50 (using either a temperature/pressure sensing arrangement or a temperature/temperature sensing arrangement) is configured to modulate the superheat valve 26 during a cooling mode of operation to maintain a superheat temperature or refrigerant near the outlet of the cooling element(s) within the range of approximately 3-8 degrees F. With a superheat temperature range of approximately 3-8 degrees, the warmest portion of the cooling element (typically a portion near the outlet of the cooling element, such as, for example, the last one or several tube passes of a coil) has a temperature during the cooling mode within a range of approximately 25-30 degrees F. Operation of the cooling element(s) 40 at a temperature below 32 degrees F. tends to results in formation of frost and/or ice on the surfaces of the cooling element(s) 40. The accumulation of ice and/or frost on the surfaces of the cooling element(s) 40 requires periodically "defrosting" the cooling element(s) 40 which tends to decrease the thermal performance of the case 10.

Referring to FIGS. 2A-2D, during a defrost mode, the control module 50 is intended to perform frequent, short duration "mini-defrosts" on the cooling element(s) 40 using the superheat valve 26 to decrease the flow rate of refrigerant through cooling element(s) 40 so that the superheat temperature of the refrigerant within the cooling element(s) 40 increases. The control module 50 conducts a mini-defrost by regulating the position of the superheat valve 26 to reduce the flow of refrigerant so that the refrigerant becomes vaporized throughout a larger portion (or all) of the cooling element(s). After the liquid-vapor mixture becomes completely vaporized during the period of reduced flow rate, the superheat temperature of the refrigerant increases so that the average temperature of the cooling element(s) 40 rises above 32 degrees F. for a relatively short period of time.

According to the exemplary embodiment with a case 10 having a refrigeration system 20 configured for a saturation temperature of approximately 22 degrees F, the control module 50 is configured to conduct mini-defrosts by modulating the superheat valve 26 to maintain a superheat temperature within the range of approximately 11-25 degrees F, so that the resulting temperature of the cooling element(s) 40 during the mini-defrosts corresponds to a range of approximately 33-47 degrees F. According to other embodiments using a different saturation temperature, the control module is configured to modulate the superheat valve to maintain a superheat temperature within a range that corresponds to an average cooling element temperature within the range of approximately 33-47 degrees F. However, the average temperature of the cooling element(s) during the mini-defrosts may be any other suitable temperature based on the type of case, the operating conditions, and/or a time or demand based defrost strategy.

The mini-defrosts are implemented by controlling the position of the superheat valve 26 to permit the temperature of suitable portions (or all) of the cooling element(s) 40 to rise above the freezing point for a short duration, and performed on a frequency intended to permit only a small layer of frost and/or ice to accumulate. The frequency and duration of the mini-defrost are intended to prevent excessive accumulation of frost and/or ice, so that frequent defrosts of short duration and low temperature increases are sufficient to prevent excessive frost accumulations and maintain a relatively "light" layer of frost between mini-defrosts, and that can be minimized or removed during each mini-defrost.

According to one embodiment, the frequency of the mini-defrosts may be based on a suitable control strategy such as a "time-based" strategy that is established according to known or predicted demand conditions. The frequency and duration may be empirically established (e.g. during initial setup, etc.) based on conditions at a particular installation location. Control module 50 may include a timer 54 operably coupled to controller 52 for initiating and terminating mini-defrost according to a predetermined schedule. Timer 54 may be adjusted locally or remotely to "tune" or adjust the parameters of the mini-defrost as necessary due to changing conditions. According to one exemplary embodiment of the time-based strategy for an open-type case, the mini-defrosts may be conducted on a frequency of approximately once each 1-2 hours (or other appropriate frequency), for a duration of up to approximately 30 minutes and more particularly of up to approximately 15 minutes (or other appropriate duration). According to another exemplary embodiment of the time based strategy for a closed door-type case, the mini-defrosts may be conducted on a frequency of approximately once per day (or other appropriate frequency) for a duration of approximately one hour (or other appropriate duration). However, any suitable frequency and duration may be used to maintain a desired defrost condition in view of a variety of factors such as case design and capacity, product loading, ambient temperature and humidity, access demand to the case, type of refrigerant, etc. Such duration and frequencies of conducting mini-defrosts are often determined by testing during setup of the case, based on the type of case, the environment at the case location, the type of demand expected for the case, etc. and are understood to vary accordingly.

According to another embodiment (shown in FIGS. 2C and 2D), the frequency of mini-defrosts may be demand-based (e.g. anticipatory, etc.) using signals representative of thermal parameters of the case that are indicative of frost accumulation and thermal performance of the case (e.g. temperature of the surface of the cooling element(s), temperature of the air space, etc., temperature difference between the airspace and the heat exchange surface, rate of change of the temperatures, frost thickness, static air pressure difference across the cooling element(s), fan motor current, etc.). Control module 50 includes a suitable computing device such as a microprocessor or programmable logic controller 52 to receive signals representative of the frost condition and initiates a mini-defrost for a suitable duration at a suitable superheat temperature according to the demand.

According to one exemplary embodiment, a demand-based mini-defrost strategy may includes monitoring any parameter such as one or more of the temperature of the air space, etc., temperature difference between the airspace and the heat exchange surface, rate of change of the temperatures, frost thickness, static air pressure difference across the cooling element(s), and/or fan motor current and initiating a mini-defrost when the parameter reaches a first setpoint (representative of the need to mini-defrost) and terminating the mini-defrost when the parameter(s) reach a second setpoint (representative of completion of the mini-defrost). According to an alternative embodiment, the mini-defrost strategy may combine both a time-based and a demand-based strategy. For example, the mini-defrost may be initiated based on a scheduled frequency and terminated based on parameter(s) indicating that frost accumulation has been sufficiently removed. Conversely, the mini-defrost may be initiated on demand by parameter(s) indicating that a frost accumulation level is sufficient to require mini-defrost and terminated based on expiration of a preset (e.g. adjustable) duration.

According to any exemplary embodiment, the defrost system is configured to conduct "mini-defrosts" using a flow control device (such as the superheat valve) to reduce refrigerant flow to the cooling element so that superheating of the vaporized refrigerant in the cooling element is sufficient to warm the coil slightly above a freezing point for a relatively short time period to minimize or eliminate frosting of the coil without excessive warming of the food products. The defrost system may be used in connection with any type of temperature controlled case having cooling elements that tend to accumulate frost and/or ice by condensation of moisture from the ambient air on the surfaces of the cooling element(s) (e.g. service cases, merchandisers, open-topped coolers, walk-in coolers, freezers, chilled food preparation or cutting tables, etc.).

It is also important to note that the construction and arrangement of the elements of the defrost system for a temperature controlled case as shown schematically in the embodiments is illustrative only. Although only a few embodiments have been described in detail in this disclosure, those skilled in the art who review this disclosure will readily appreciate that many modifications are possible (e.g., variations in mini-defrost frequency and duration, flow rate of the refrigerant during mini-defrost, combinations and permutations of mini-defrost with conventional defrost strategies, methods and components for reducing refrigerant flow during mini-defrost, variations in superheat temperature during mini-defrost, values of parameters, etc.) without materially departing from the novel teachings and advantages of the subject matter recited.

It should also be noted that suitable sensors may be provided within the case or integrally (or otherwise operably coupled) with the cooling elements(s) to provide input to the defrost control system. For example, one or more temperature sensing devices (e.g. thermocouples, RTDs, etc.) may be provided at suitable location(s) within, or on the top side or underside of shelves or other product support surfaces to provide a signal representative of temperature of the product support surface and/or food products to the defrost control system. The control module may include a processor such as a microprocessor, programmable logic controller or the like for receiving and monitoring input signals, sending output signals, permitting change or adjustment of set points, providing appropriate indications (e.g. alarms, status, temperature, fluid flow rates, mode of operation (such as cooling or defrost), etc.) and to interface with local or remote monitoring equipment or stations. The control module may also be configured to initiate and terminate a defrost mode of operation in any suitable manner. Defrosting of the cooling element(s) may be accomplished by mini-defrosts alone, or in combination with other defrost methods such as stopping the flow of fluid for a sufficient period of time to allow frost and/or ice to melt (e.g. "time-off"), or energizing electrical heating elements (e.g. wires, etc.—not shown) formed in or located adjacent to the cooling element(s), or circulating a "warmed" fluid through the cooling elements (such as may be warmed by "hot gas" etc.) or other suitable method. The defrost mode may be initiated and terminated based on suitable signals received by the defrost control system, or by a timer, or other suitable method. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. A temperature controlled case, comprising:

an enclosure defining an airspace for receiving products therein;

a refrigeration system configured to circulate a refrigerant through an expansion device and at least one cooling element to cool the airspace; and a control module configured to modulate a position of the expansion device during a cooling mode so that a flow rate of the refrigerant corresponds to a first cooling element temperature less than or equal to approximately 32 degrees F. and to modulate a position of the expansion device during a defrost mode to reduce the flow rate of the refrigerant to correspond to a second cooling element temperature greater than approximately 32 degrees F.;

wherein the control module is configured to initiate the defrost mode on a time-based frequency.

2. The temperature controlled case of claim 1 wherein the first cooling element temperature is within the range of approximately 17-32 degrees F.

3. The temperature controlled case of claim 1 wherein the second cooling element temperature is within the range of approximately 33-47 degrees F.

4. The temperature controlled case of claim 1 wherein the time-based frequency is at least once in a two hour period.

5. The temperature controlled case of claim 1 wherein the time-based frequency is approximately once per day.

6. The temperature controlled case of claim 1 wherein a duration of the defrost mode is less than approximately 30 minutes.

7. The temperature controlled case of claim 1 wherein a duration of the defrost mode is less than approximately 15 minutes.

8. The temperature controlled case of claim 1 wherein the expansion device is a superheat valve.

9. A refrigeration device, comprising:

a case having a space configured to receive products to be cooled;

at least one cooling element coupled to the case and configured to provide cooling to the space;

a refrigeration system having a supply line and a return line configured to circulate a refrigerant through the cooling element;

an expansion device coupled to the supply line;

a control module operable to defrost the cooling element at periodic intervals by modulating the expansion device to reduce a flow rate of the refrigerant and increase a superheat temperature of the refrigerant within the cooling element so that an average temperature of the cooling element exceeds 32 degrees F. for a predetermined duration;

wherein the control module operates on a demand-based strategy so that the periodic intervals include one frequency during one demand period and another frequency during another demand period.

10. The refrigeration device of claim 9 wherein the control module is configured to receive a signal representative of a saturation temperature of the refrigerant.

11. The refrigeration device of claim 10 wherein the control module is configured to receive a signal representative of a superheat temperature of the refrigerant proximate the cooling element.

12. The refrigeration device of claim 11 wherein the control module provides an output signal to the expansion device based on comparison of the superheat temperature of the refrigerant to a defrost mode superheat reference temperature.

13. The refrigeration device of claim 9 wherein the periodic intervals are within a range of approximately ½ hour-2 hours.

14. The refrigeration device of claim 9 wherein the periodic intervals are approximately once per day.

15. The refrigeration device of claim 13 wherein the predetermined duration is up to approximately 30 minutes.

16. The refrigeration device of claim 9 wherein an average temperature of the cooling element during the defrost mode is within the range of approximately 33-47 degrees F.

17. A defrost system for a temperature controlled storage unit, comprising:

an enclosure providing a space for receiving products;

a refrigeration system having a supply line and a return line coupled to a cooling element and configured to circulate a refrigerant through the cooling element to provide cooling to the space; and a control module configured to initiate a plurality of defrost modes on a predetermined frequency and for a predetermined duration by reducing a flow rate of the refrigerant through the cooling element so that a superheat temperature of the refrigerant in the cooling coil is increased to a predetermined range;

wherein the predetermined frequency and the predetermined duration and the predetermined range are selected to obtain a substantially frost-free condition on the cooling element following the defrost modes.

18. The defrost system of claim 17 further comprising a superheat valve coupled to the supply line and configured to receive a signal from the control module to regulate the flow rate of refrigerant through the cooling element.

19. The defrost system of claim 17 wherein the control module further comprises a timer device configured to initiate the defrost modes at the predetermined frequency.

20. The defrost system of claim 17 wherein the predetermined frequency and the predetermined duration and the predetermined range are established based on testing.

21. The defrost system of claim 17 wherein the predetermined frequency and the predetermined duration and the predetermined range are selected to maintain the products substantially within a predetermined product temperature range during the defrost modes.

22. A method for defrosting a temperature controlled case, comprising:

providing an enclosure having a space configured to receive products to be cooled;

providing a cooling element configured to receive a refrigerant at a first flow rate to cool the space;

providing a control module operable to receive signals representative of at least one of a refrigerant pressure and a refrigerant temperature and to module a superheat valve to conduct mini-defrosts on the cooling element by reducing the flow rate of the refrigerant through the cooling element to a second flow rate so that a superheat temperature of the refrigerant is sufficient to warm the cooling element above freezing.

23. The method of claim 22 wherein the control module is configured to conduct the mini-defrosts at least once in a two hour period.

24. The method of claim 23 wherein a duration of the mini-defrosts is less than approximately 30 minutes.

25. The method of claim 22 wherein the control module is configured to conduct the mini-defrosts on a frequency and for a duration based on a demand indicated by at least one parameter.

26. The method of claim 25 wherein the at least one parameter is one or more of an air temperature of the space, a difference between the air temperature of the space and a surface temperature of the cooling element, a thickness of frost on the cooling element, an air pressure difference across the cooling element, and a fan motor current.

27. The method of claim 22 wherein the control module is configured to regulate the superheat valve during the mini-defrost based on a signals representative of a temperature and a pressure of the refrigerant proximate an outlet of the cooling element.

28. The method of claim 22 wherein the control module is configured to regulate the superheat valve during the mini-defrost based on a signal representative of a temperature of the refrigerant proximate an outlet of the cooling element and a signal representative of a temperature of the refrigerant proximate an inlet of the cooling element.

29. A refrigeration device, comprising:

a case having a space configured to receive products to be cooled;

at least one cooling element coupled to the case and configured to provide cooling to the space;

a refrigeration system having a supply line and a return line configured to circulate a refrigerant through the cooling element;

an expansion device coupled to the supply line;

a control module operable to defrost the cooling element at periodic intervals by modulating the expansion device to reduce a flow rate of the refrigerant and increase a superheat temperature of the refrigerant within the cooling element so that an average temperature of the cooling element exceeds 32 degrees F. for a predetermined duration;

wherein the control module is configured to receive a signal representative of a saturation temperature of the refrigerant, and to receive a signal representative of a superheat temperature of the refrigerant proximate the cooling element, and to provide an output signal to the expansion device based on a comparison of the superheat temperature of the refrigerant to a defrost mode superheat reference temperature.

30. The refrigeration device of claim 29 wherein an average temperature of the cooling element during the defrost mode is within the range of approximately 33-47 degrees F.

* * * * *